US012721422B1

(12) United States Patent
Zhang

(10) Patent No.: US 12,721,422 B1
(45) Date of Patent: Sep. 1, 2026

(54) BATH BRUSH

(71) Applicant: Ce Zhang, Xiangfan (CN)

(72) Inventor: Ce Zhang, Xiangfan (CN)

( * ) Notice: Subject to any disclaimer, the term of this patent is extended or adjusted under 35 U.S.C. 154(b) by 0 days.

(21) Appl. No.: 19/342,873

(22) Filed: Sep. 29, 2025

(30) Foreign Application Priority Data

Aug. 6, 2025 (CN) ..... 202521662926.7

(51) Int. Cl.
*A46B 5/00* (2006.01)
*A46B 5/02* (2006.01)
*A46B 13/02* (2006.01)

(52) U.S. Cl.
CPC ..... *A46B 5/0095* (2013.01); *A46B 5/026* (2013.01); *A46B 13/023* (2013.01); *A46B 2200/1006* (2013.01)

(58) Field of Classification Search
CPC ..... A46B 2200/1006; A46B 5/0095; A46B 5/026; A46B 13/023
See application file for complete search history.

(56) References Cited

U.S. PATENT DOCUMENTS 4,420,853 A * 12/1983 Gilman ..... A46B 15/0081 15/160
4,730,949 A * 3/1988 Wilson ..... A46B 11/001 604/3
5,312,197 A * 5/1994 Abramson ..... A46B 11/00 401/11
8,230,544 B2 * 7/2012 Leshko ..... A46B 15/00 15/160
9,095,373 B2 * 8/2015 Guynn ..... A46B 5/0008
2002/0002984 A1 * 1/2002 Loy ..... A47K 7/03 15/160
2003/0156884 A1 * 8/2003 Teh ..... A46B 9/02 401/38
2006/0168746 A1 * 8/2006 Guyuron ..... A47K 7/04 15/23
2009/0188528 A1 * 7/2009 Junkins ..... A46B 5/0095 15/28
2020/0253811 A1 * 8/2020 Alexander ..... A61N 1/36014
2021/0393088 A1 * 12/2021 Roden, II ..... A46B 15/0051
2022/0031056 A1 * 2/2022 Peng ..... A46B 5/0095
(Continued)

FOREIGN PATENT DOCUMENTS

CN 219250002 U * 6/2023
CN 219878019 U * 10/2023
CN 117378952 A * 1/2024 ..... A47K 7/02
(Continued)

OTHER PUBLICATIONS

CN 117378952 A—English Machine Translation (Year: 2024).*
CN 119867571 A—English Machine Translation (Year: 2025).*

*Primary Examiner* — Marc Carlson

(57) ABSTRACT

A bath brush includes a bath brush body. The bath brush body includes a handle portion and a brush head portion. The brush head portion includes a front side and a back side. The front side and/or the back side is provided with first brush bristles for cleaning stains on a large area of superficial skin of a user. A lateral portion of the brush head portion extends outward in a vertical or horizontal direction to form a lateral brush portion. Second brush bristles are fixed on the lateral brush portion, which are specifically used for cleaning narrow spaces of the skin surface of the user.

13 Claims, 8 Drawing Sheets

(56) References Cited

U.S. PATENT DOCUMENTS

2025/0194784 A1* 6/2025 Hahn ..... A46B 5/021

FOREIGN PATENT DOCUMENTS

| | | | | | |
|---|---|---|---|---|---|
| CN | 220588144 | U | * | 3/2024 | |
| CN | 119867571 | A | * | 4/2025 | ..... A46B 7/08 |
| DE | 102016107195 | A1 | * | 10/2017 | ..... A46B 5/0095 |
| KR | 102053114 | B1 | * | 12/2019 | ..... A47K 7/04 |
| WO | WO-2014118596 | A1 | * | 8/2014 | ..... A46B 13/023 |

* cited by examiner

BATH BRUSH

CROSS-REFERENCE TO RELATED APPLICATIONS

This application claims priority to Chinese Patent Application No. 202521662926.7, filed on Aug. 6, 2025, which is hereby incorporated by reference in its entirety.

TECHNICAL FIELD

The present disclosure relates to the technical field of bath tools, and in particular to, a bath brush.

BACKGROUND

As a common personal care tool, a bath brush is mainly used for cleaning the body, removing dead skin, and promoting blood circulation. In terms of design, an existing bath brush is basically composed of a handle and a brush head. The brush head is usually covered with soft brush bristles or a sponge to ensure gentle contact with the skin. Most bath brushes on the market adopt a simple panel-shaped design. A brush bristle layer is mounted on the brush head. The cleaning work is completed through the contact between the brush bristles of the brush head portion and the skin. Although this conventional design meets basic cleaning needs in terms of function, its innovation in terms of personalization and versatility remains limited.

Currently, the design of bath brushes is relatively monotonous, focusing mainly on basic scrubbing functions and lacking a more diversified user experience. For example, (1) due to the integral panel-shaped design of existing brush heads, the bath brushes can only be used for contact with large-area parts of the body, thus ignoring use in other narrow spaces such as toe gaps, gluteal clefts, and inguinal regions; (2) since the handle portions and the brush head portions of existing brush heads are integrally fixed, the overall length cannot be flexibly adjusted or the brush head cannot be replaced with a new brush head; and (3) most existing bath brushes require users to manually contact the skin for scrubbing and cleaning, resulting in a deficiency in terms of comfort.

SUMMARY

An objective of the present disclosure is to provide a bath brush, which aims to solve the problems that an existing bath brush is single in function, can only contact a large area of skin, and cannot be transformed to an overall appropriate state by length adjustment.

The present disclosure is implemented in the following manner: A bath brush includes a bath brush body. The bath brush body includes a handle portion and a brush head portion. The brush head portion includes a front side and a back side. The front side and/or the back side are/is provided with first brush bristles for cleaning stains on a large area of superficial skin of a user. A lateral portion of the brush head portion extends outward in a vertical or horizontal direction to form a lateral brush portion. Second brush bristles are fixed on the lateral brush portion, which are specifically used for cleaning narrow spaces of the skin surface of the user.

Further, the brush head portion is configured in a plate shape, the lateral portion of the brush head portion is in an arc shape or rectangular shape, and the lateral brush portion is located in an arc-shaped or rectangular area or a local area of the lateral portion; and the brush head portion and/or the handle portion are/is made of a common plastic material or an antibacterial plastic material.

Further, a connecting assembly for assembling and dissembling the brush head portion and the handle portion is arranged at a tail portion of the brush head portion and a front end of the handle portion, and the connecting assembly includes an assembly head and an assembly hole formed between the brush head portion and the handle portion.

Further, the assembly head and the assembly hole are connected by means of threaded connection or snap-fit connection.

Further, magnetic attraction sheets magnetically attracting each other are disposed on the assembly head and in the assembly hole.

Further, the front end of the handle portion is disposed as a plurality of telescopic joints for adjusting a length of the bath brush body, adjacent telescopic joints are capable of telescopically sliding relatively, and fixing threads for fixing the telescopic joints are disposed at a connection between the adjacent telescopic joints.

Further, a vibration motor is disposed in the brush head portion, an offset wheel is disposed on the vibration motor, an electric control assembly electrically connected to the vibration motor and a storage battery for supplying electric energy are disposed in the handle portion, and a control button for starting the vibration motor is disposed on the handle portion.

Further, the handle portion is internally provided with a charging female socket extending out along the tail portion; and the bath brush further includes a waterproof rubber plug in threaded connection or plug-in connection to the handle portion.

Further, an anti-slip rubber layer is disposed on a surface layer of the handle portion, and the anti-slip rubber layer is provided with an array of grip holes in a concave shape.

Further, a hanging hole portion is formed in a tail end of the handle portion.

Compared with the prior art, the present disclosure has the following beneficial effects:

(1) The brush bristles arranged on the front side and the back side of the bath brush are used for cleaning stains on the large area of superficial skin of the user, and those arranged on the lateral portion of the bath brush are specifically used for cleaning narrow spaces of the skin surface of the user.

(2) In the bath brush, the connecting assembly is disposed between the brush head and the handle. The brush head is detachably connected to the handle, such that the brush head is conveniently replaced in a later period. Moreover, other brush heads with different functions or shapes may also be purchased in use.

(3) In the bath brush, the telescopic joints are disposed at the front end of the handle portion, and the overall length of the bath brush is adjusted by the telescopic joints to fit users with different heights.

(4) In the bath brush, the vibration motor is disposed, and after being started, the vibration motor may vibrate to achieve a massage function for deep vibratory cleaning.

Figure 1:
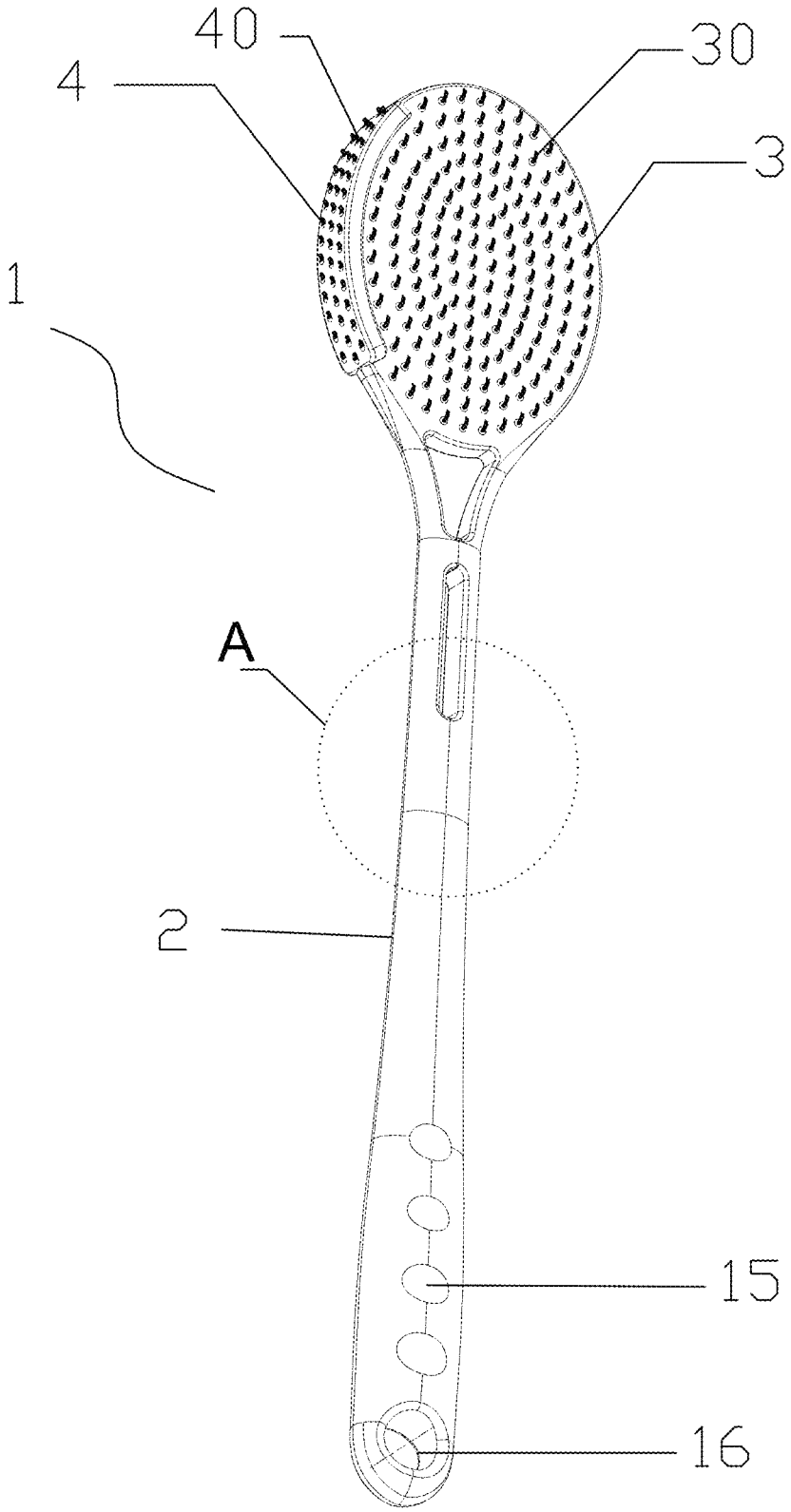
FIG. 1 is a schematic structural view of Embodiment I of the present disclosure.

Reference numerals in the drawings: 1, bath brush body; 2, handle portion; 3, brush head portion; 4, lateral brush portion; 5, assembly head 6, assembly hole; 7, magnetic attraction sheet; 8, telescopic joint; 9, vibration motor; 10, offset wheel; 11, storage battery; 12, control button; 13, charging female socket; 14, waterproof rubber plug; 15, grip hole; 16, hanging hole portion; 40, first brush bristle; 30, second brush bristle; 17, connecting assembly; 80, fixing thread; and 20, anti-slip rubber layer.

DESCRIPTION OF EMBODIMENTS

In the present disclosure, unless explicitly specified and defined otherwise, the terms "mount", "connection", "connect", and "fix" should be understood in a broad sense. For example, the terms may indicate a fixed connection, a detachable connection, or an integral connection, may indicate a mechanical connection or an electrical connection, may indicate a direct connection or an indirect connection via an intermediate medium, or internal communication between two elements or an interaction relationship between two elements. Those skilled in the art can understand specific meanings of these terms in the present application according to specific;

Unless otherwise defined, all technical and scientific terms used herein have the same meanings as commonly understood by those skilled in the art to which the present disclosure belongs. The terms used in the specification of the present disclosure herein are only for the purpose of describing specific embodiments and are not intended to limit the present disclosure. The term "and/or" as used herein includes any and all combinations of one or more of the associated listed items.

Figure 2:
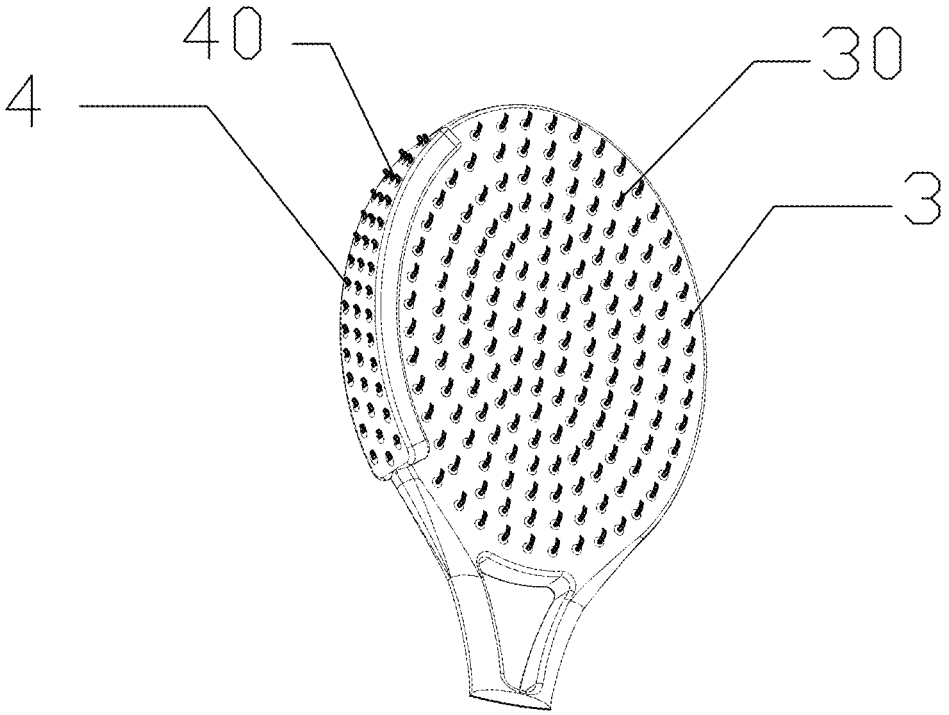
FIG. 2 is a schematic structural view of a brush head portion in FIG. 1.

A further description will be made below in conjunction with drawings and specific embodiments:

Embodiment I: With reference to FIG. 1 and FIG. 2, in this technical solution, based on a bath brush body 1 mainly composed of a handle portion 2 and a brush head portion 4, two targeted designs are provided for different cleaning positions. In this design, the brush head portion 4 includes a front side and a back side. The front side and/or the back side is provided with the first brush bristles 40 for cleaning stains on a large area of superficial skin of a user, such as areas like the back and the breast of the body. The first brush bristles 40 are designed to efficiently cover and clean flat skin surface and remove daily dirt such as sweat stains and grease. The lateral portion of the brush head portion 4 extends outward in a vertical or horizontal direction to form the lateral brush portion 3. Second brush bristles 30 are fixed on the lateral brush portion 3, which are specifically used for cleaning narrow spaces of the skin surface of the user, such as toe gaps, gluteal clefts, inguinal regions or other parts. The second brush bristles 30 are designed to penetrate into these hard-to-reach areas, so as to effectively remove fine stains and cutin.

The brush head portion 4 is configured in a plate shape. The lateral portion of the brush head portion 4 is in an arc shape. The lateral brush portion 3 is in the arc-shaped local area of the lateral portion. The plate shape itself is large in area, thus correspondingly making large-scale contact with the superficial skin of the user. The arc shape of the lateral portion itself is small in area, so the design point of the lateral brush portion 3 on the lateral portion can facilitate the cleaning of narrow spaces. The brush head portion 4 and/or the handle portion 2 are/is made of a common plastic material or an antibacterial plastic material. In this embodiment, the brush head portion 4 and/or the handle portion 2 are/is made of the antibacterial plastic material, so as to prevent the growth of mold or bacteria on the surfaces of the brush head portion 4 and/or the handle portion 2, which may affect human health. The antibacterial plastic material is a functional plastic material prepared by adding antibacterial agents (such as silver ions, zinc ions, copper ions, or organic antibacterial agents). The antibacterial plastic material can inhibit or kill microorganisms such as bacteria and mold attached to the surface.

Embodiment II: With reference to FIG. 3, FIG. 4, FIG. 5, and FIG. 6, in Embodiment II, based on Embodiment I, through a structural design, the handle portion 2 and the brush head portion 4 can be assembled and disassembled, which facilitates replacement of the brush head in the later period. Moreover, other brush heads with different functions or shapes may also be purchased in use. A specific structural design is as follows: A connecting assembly 17 for assembling and dissembling the brush head portion and the handle portion is arranged on a tail portion of the brush head portion 4 and a front end of the handle portion 2, and the connecting assembly 17 includes an assembly head 5 and an assembly hole 6 formed between the brush head portion 4 and the handle portion 2. The assembly head 5 and the assembly hole 6 are connected by means of threaded connection or snap-fit connection. The threaded connection may be realized by disposing corresponding internal thread and external thread at the assembly head 5 and the assembly hole 6. The snap-fit connection may be realized as follows: A flexible protrusion (such as an elastic sheet) is disposed at the assembly head 5 and the assembly hole 6, the lateral portion of the assembly head 5 is provided with another flexible protrusion (such as an elastic sheet) in snap-fit with the flexible protrusion, and the assembly head is plugged out from the assembly hole 6. The third connecting mode is as follows: Magnetic attraction sheets 7 magnetically attracting each other are disposed between the assembly head 5 and the assembly hole 6, and the assembly head and the assembly hole are assembled and connected by means of magnetic attraction. The magnetic attraction sheets 7 are specifically magnets.

Figure 3:
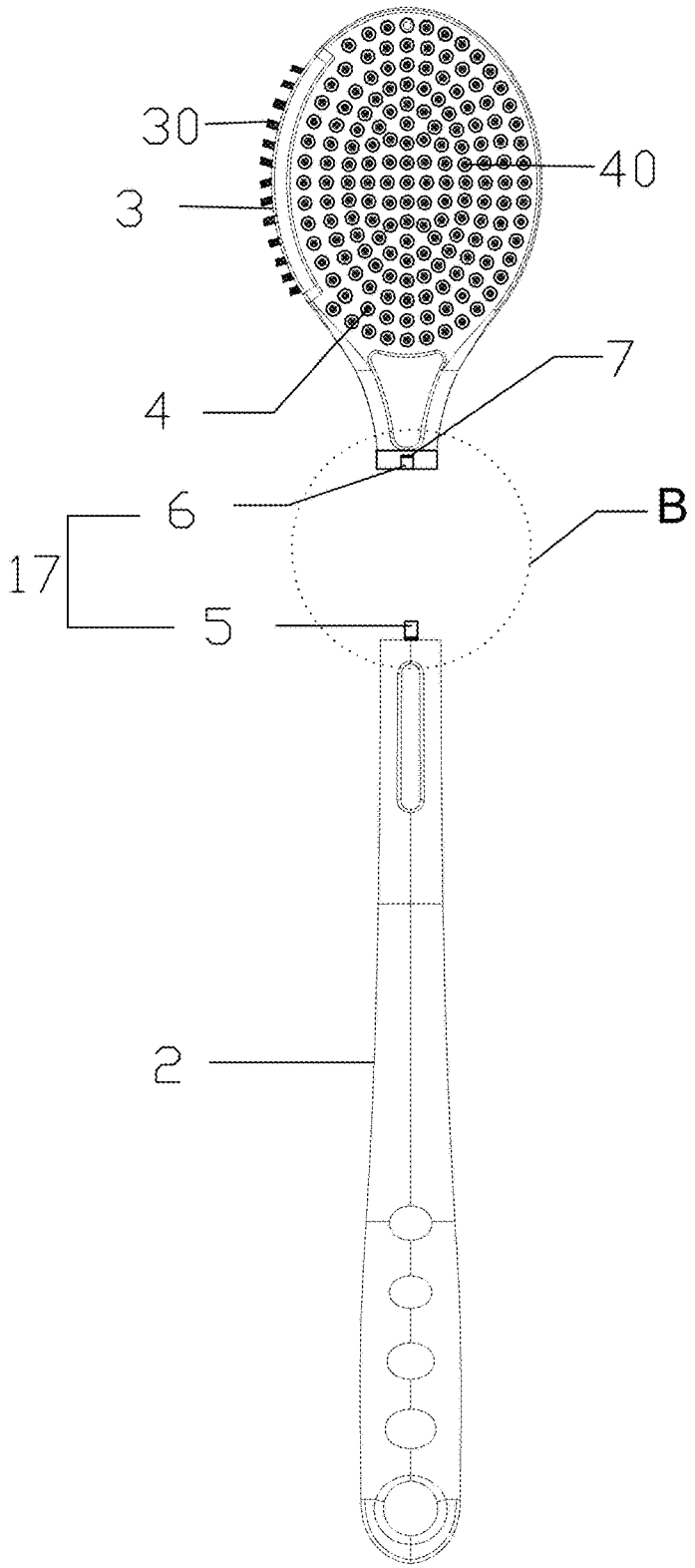
FIG. 3 is a schematic structural view of Embodiment II of the present disclosure.
Figure 4:
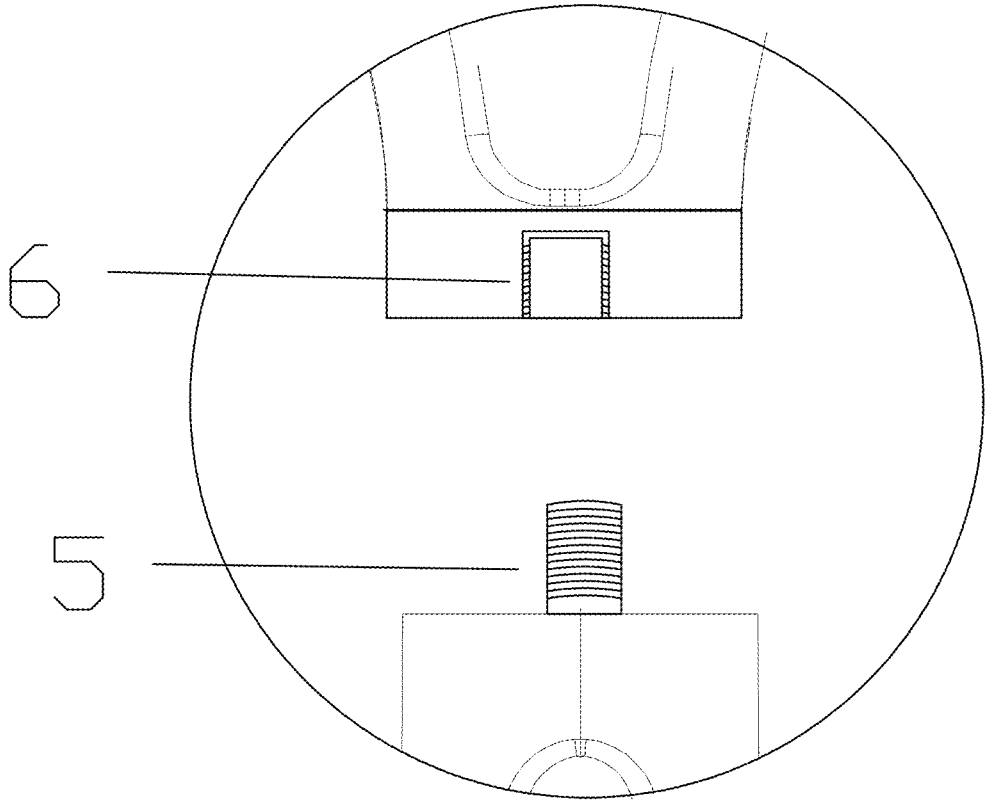
FIG. 4 is a schematic structural view of a connecting assembly in a threaded connection manner at a portion B in FIG. 3.
Figure 5:
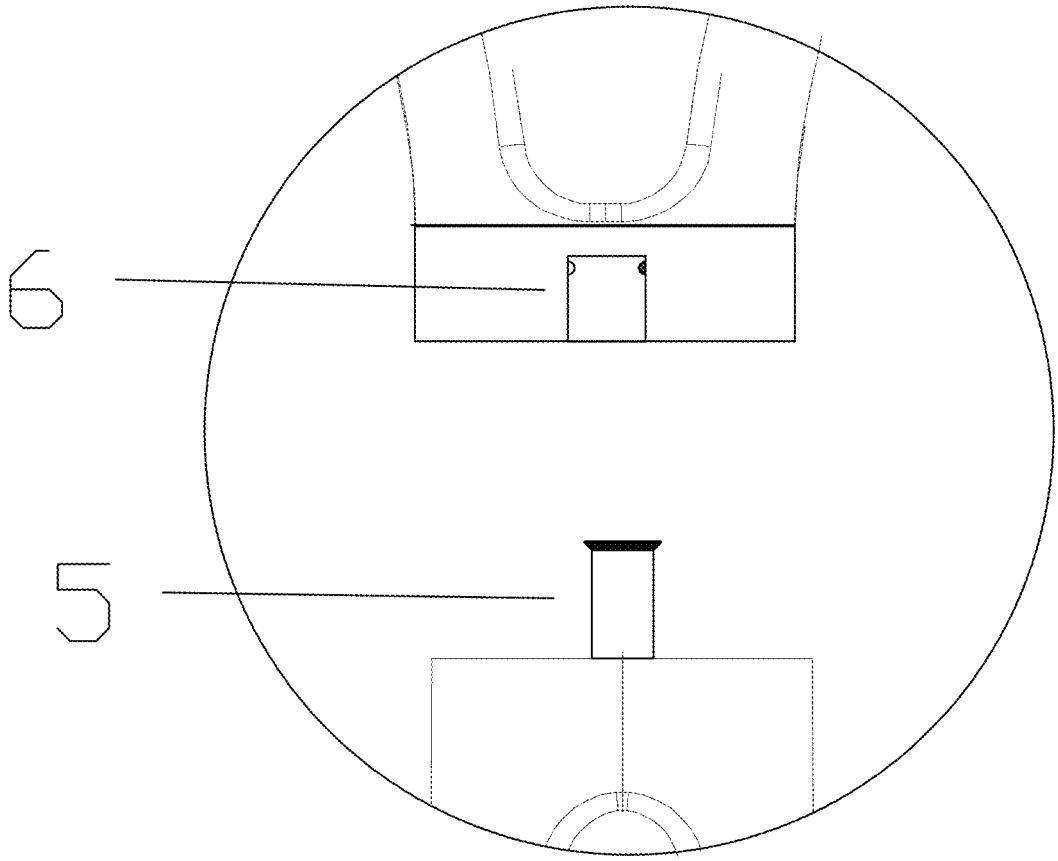
FIG. 5 is a schematic structural view of the connecting assembly in a snap-fit connection manner at the portion B in FIG. 3.
Figure 6:
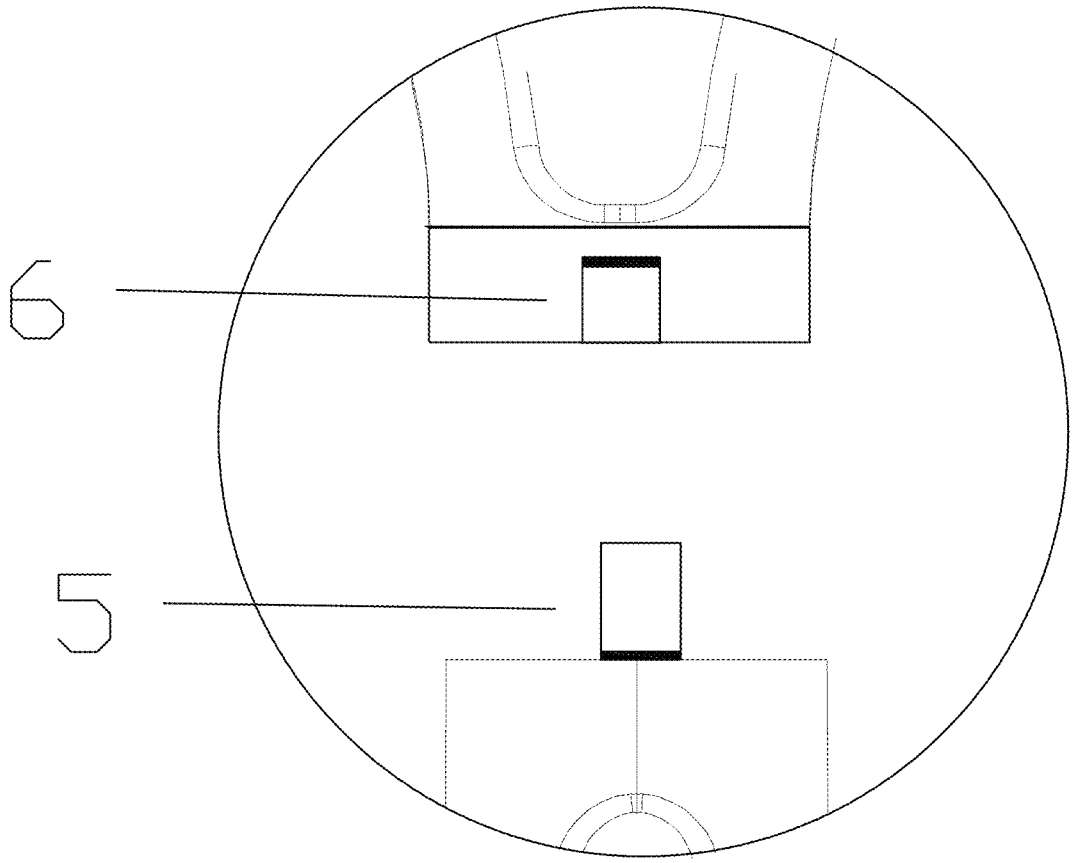
FIG. 6 is a schematic structural view of the connecting assembly in a magnetic attraction connection manner at the portion B in FIG. 3.
Figure 7:
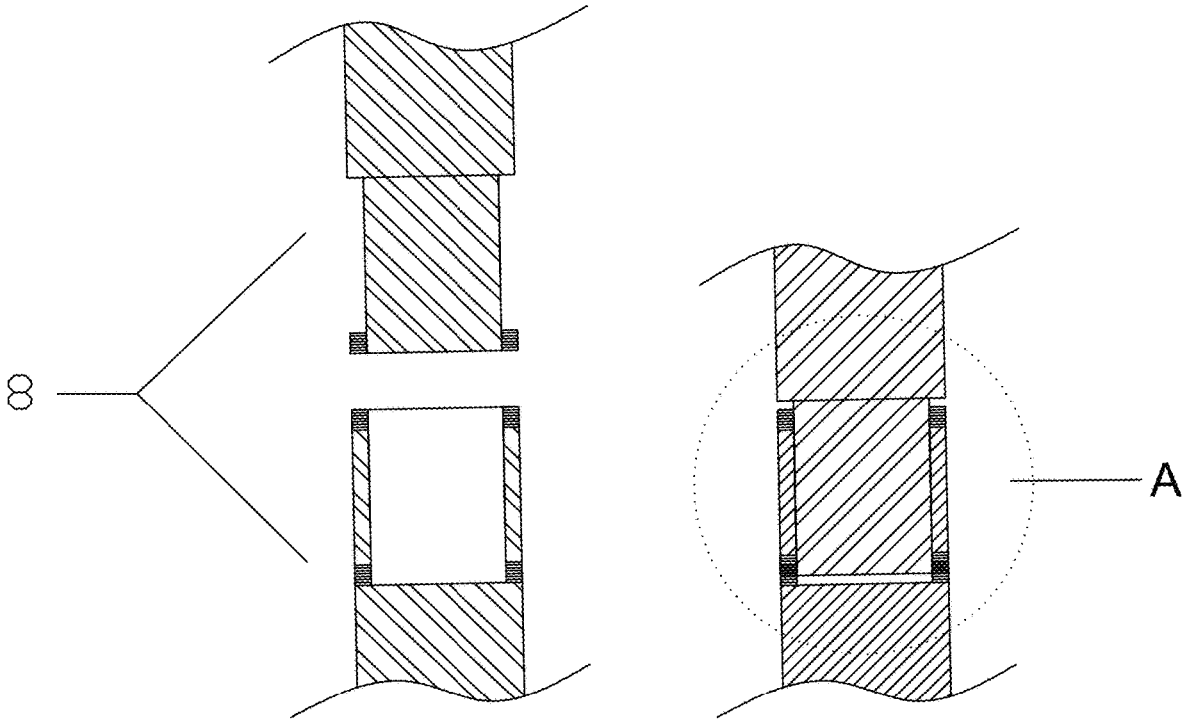
FIG. 7 is a schematic structural view of a telescopic connection of telescopic joints at a portion A in FIG. 1.

Embodiment III: with reference to FIG. 1, FIG. 3, and FIG. 7, FIG. 7 represents the connection between adjacent telescopic joints 8 of a portion A in FIG. 1.

In Embodiment III, based on Embodiment I or II, through the structural design, the bath brush body 1 is telescopic to fit users with different heights in use. A specific structural design is as follows: The front end of the handle portion 2 is disposed as a plurality of telescopic joints 8 for adjusting a length of the bath brush body 1, adjacent telescopic joints 8 are capable of telescopically sliding relatively, and fixing threads 80 for fixing the telescopic joints is disposed at a connection between the adjacent telescopic joints 8. Specifically, the connecting external thread is disposed on the surface layer of the corresponding telescopic joint 8, at least two internal threads are disposed on an inner side wall of the corresponding telescopic joint 8, and the distance between the two internal threads is a path of a telescopic length.

Figure 8:
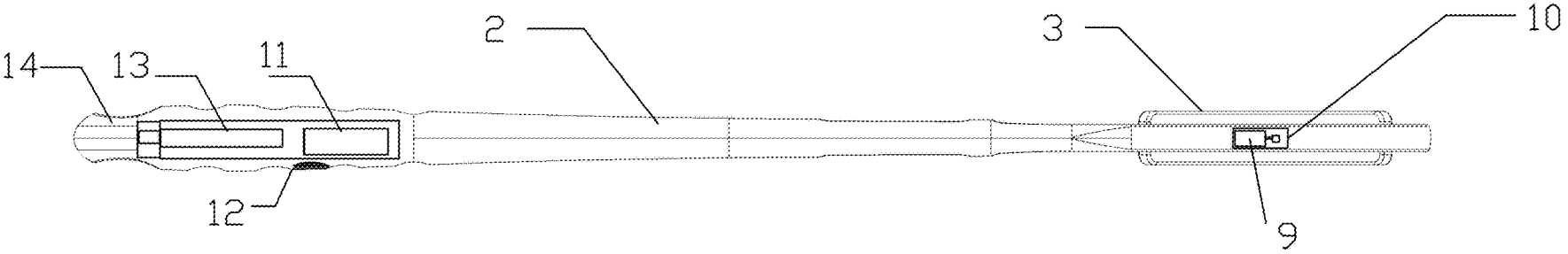
FIG. 8 is a schematic structural view of a vibration motor in a bath brush body in FIG. 1.

Embodiment IV: with reference to FIG. FIG. 1, FIG. 3, and FIG. 8, in Embodiment IV based on Embodiment I or III, through the structural design, a function of vibrating to massage may be achieved for deep vibratory cleaning. A specific structural design is as follows: A mounting chamber is disposed in the brush head portion 4, the vibration motor 9 is fixedly connected to the mounting chamber, an offset wheel 10 is disposed on the vibration motor 9, an electronic control assembly electrically connected to the vibration motor 9 and a storage battery 11 for supplying electric energy are disposed on the handle portion 2, the electric control assembly includes a circuit board, and a driving circuit disposed on the circuit board and a circuit component matching the driving circuit, the handle portion 2 is provided with a control button 12 for starting the vibration motor 9, the handle portion 2 is internally provided with a charging female socket 13 extending out along the tail portion, the control button 12 and the charging female socket 13 are fixedly connected to the circuit board, the control button 12 is configured to start and stop the vibration motor 9 and adjust the vibration intensity, the charging female socket 13 is configured to supplement electric energy to the storage battery 11, the top of the control button 12 penetrates through a shell of the corresponding handle portion 2, and a waterproof silicone sleeve is sleeved on the control button 12 to enhance the airtightness. The bath brush further includes a waterproof rubber plug 14 in threaded connection or plug-in connection to the handle portion 2. In this embodiment, the brush head portion 4 is internally provided with a sealed space (the brush head portion 4 is made of a flexible material), the vibration motor 9 is disposed in the sealed space, and the offset wheel 10 is disposed at the upper end of the vibration motor 9. After being stared, the vibration motor has a vibration effect. The bath brush is more comfortably used and achieves cleaner cleaning. The charging female socket 13 is used for storing electric energy for the storage battery 11. The waterproof rubber plug 14 is opened, such that the charging female socket 13 may be charged. After the charging female socket is charged, the waterproof rubber plug 14 is then closed in a sealing manner.

Further, in the above embodiment, an anti-slip rubber layer 20 is further disposed on the surface layer of the handle portion 2, and the anti-slip rubber layer 20 is provided with grip holes 15 with a concave shape in an array. A hanging hole portion 16 is formed in a tail end of the handle portion 2. The anti-slip rubber layer 20 can significantly increase the frictional force of the handle. Even in a wet hand or moist environment, the handle is not prone to sliding, such that the holding stability of the user is improved. The design of the concave grip holes 15 helps the fingers form a more fitting contact with the surface of the handle. The hanging hole portion 16 is convenient for the user to hang the handle on a hook or another support, facilitating storage and organization after use.

The above are only preferred embodiments of the present disclosure and are not intended to limit the present disclosure; for those skilled in the art, various modifications and changes may be made to the present disclosure. Any modifications, equivalent substitutions, improvements, and the like made within the spirit and principles of the present disclosure shall be included within the protection scope of the present disclosure.

What is claimed is:

1. A bath brush, comprising a bath brush body, wherein the bath brush body comprises a handle portion and a brush head portion fixedly or detachably connected to the handle portion;

the brush head portion comprises;

a front side and a back side, the front side and/or the back side being provided with first brush bristles for cleaning stains on a large area of superficial skin of a user; and a lateral brush portion, formed by outwardly extending a lateral portion of the brush head portion, second brush bristles being fixed on the lateral brush portion, which are specifically used for cleaning narrow spaces of the skin surface of the user;

wherein the handle portion is connected to a bottom side of the brush head portion, and the lateral brush portion is arranged at a left side or a right side of the brush head portion;

wherein the lateral brush portion comprises a lateral surface extending at least from the back side to the front side of the brush head portion, and the second brush bristles are fixed on the lateral surface and extend in a direction different from, and substantially perpendicular to, the first brush bristles.

2. The bath brush according to claim 1, wherein the brush head portion is configured in a plate shape, the lateral portion of the brush head portion is in an arc shape or rectangular shape, and the lateral brush portion is located on an arc-shaped or rectangular area or a local area of the lateral portion; and the brush head portion and/or the handle portion are/is made of a common plastic material or an antibacterial plastic material.

3. The bath brush according to claim 1, wherein a connecting assembly for assembling and dissembling the brush head portion and the handle portion is arranged at a tail portion of the brush head portion and a front end of the handle portion, and the connecting assembly comprises an assembly head and an assembly hole formed between the brush head portion and the handle portion.

4. The bath brush according to claim 3, wherein the assembly head and the assembly hole are connected through threaded connection or snap-fit connection.

5. The bath brush according to claim 3, wherein magnetic attraction sheets magnetically attracting each other are disposed on the assembly head and in the assembly hole.

6. The bath brush according to claim 1, wherein the front end of the handle portion is disposed as a plurality of telescopic joints for adjusting a length of the bath brush body, adjacent telescopic joints are capable of telescopically sliding relatively, and fixing threads for fixing the telescopic joints are disposed at a connection between the adjacent telescopic joints.

7. The bath brush according to claim 1, wherein a vibration motor is disposed in the brush head portion, an offset wheel is disposed on the vibration motor, an electric control assembly electrically connected to the vibration motor and a storage battery for supplying electric energy are disposed in the handle portion, and a control button for starting the vibration motor is disposed on the handle portion.

8. The bath brush according to claim 7, wherein the handle portion is internally provided with a charging female socket extending out along the tail portion; and the bath brush further comprises a waterproof rubber plug in threaded connection or plug-in connection to the handle portion.

9. The bath brush according to claim 1, wherein an anti-slip rubber layer is disposed on a surface layer of the handle portion, and the anti-slip rubber layer is provided with an array of grip holes in a concave shape.

10. The bath brush according to claim 9, wherein a hanging hole portion is formed in a tail end of the handle portion.

11. The bath brush according to claim 1, wherein the front side comprises a front surface on which the first brush bristles are fixed, or the back side comprises a back surface on which the first brush bristles are fixed; and substantially along an extending direction of the first brush bristles, the lateral brush portion extends beyond the front surface or the back surface.

12. The bath brush according to claim 11, wherein along a vertical direction from the bottom side to a top side of the brush head portion, the first brush bristles occupy a first length, and the lateral surface extends at least a half of the first length.

13. The bath brush according to claim 1, wherein the brush head portion comprises two of the lateral brush portions arranged respectively at the left side and the right side thereof.

* * * * *